US007552571B2

(12) United States Patent
Lerner et al.

(10) Patent No.: US 7,552,571 B2
(45) Date of Patent: Jun. 30, 2009

(54) PACKAGING MACHINE AND PROCESS

(75) Inventors: Hershey Lerner, Aurora, OH (US); Dana J. Liebhart, Streetsboro, OH (US)

(73) Assignee: Automated Packaging Systems, Inc., Streetsboro, OH (US)

( * ) Notice: Subject to any disclaimer, the term of this patent is extended or adjusted under 35 U.S.C. 154(b) by 31 days.

(21) Appl. No.: 11/771,132

(22) Filed: Jun. 29, 2007

(65) Prior Publication Data

US 2008/0010955 A1 Jan. 17, 2008

Related U.S. Application Data

(62) Division of application No. 11/363,337, filed on Feb. 27, 2006, now Pat. No. 7,258,656, which is a division of application No. 10/738,694, filed on Dec. 17, 2003, now abandoned.

(51) Int. Cl.
*B65B 51/16* (2006.01)

(52) U.S. Cl. ..... 53/374.3; 53/550; 53/570; 53/384.1

(58) Field of Classification Search ..... 53/457, 53/459, 477, 373.7, 375.9, 202, 570, 550, 53/384.1, 386.1, 374.3; 493/193, 198, 205–208
See application file for complete search history.

(56) References Cited

U.S. PATENT DOCUMENTS

| | | | | |
|---|---|---|---|---|
| 2,760,621 | A | 8/1956 | Cresenzo | |
| 4,565,046 | A | 1/1986 | Stumpf | |
| 4,578,924 | A | 4/1986 | DeCrane et al. | |
| 4,835,948 | A | 6/1989 | Humphrey | |
| 4,969,310 | A | 11/1990 | Lerner et al. | |
| 5,058,364 | A * | 10/1991 | Seiden et al. | 53/455 |
| 5,115,626 | A | 5/1992 | Rutter et al. | |
| 5,187,917 | A | 2/1993 | Mykleby | |
| 5,279,095 | A * | 1/1994 | Muller | 53/386.1 |
| 5,479,759 | A | 1/1996 | Gorlich et al. | |
| 5,511,363 | A | 4/1996 | Doede | |
| 5,640,834 | A | 6/1997 | Lerner et al. | |
| 5,642,599 | A | 7/1997 | Tisma | |
| 5,722,218 | A | 3/1998 | Lerner | |
| 5,733,045 | A | 3/1998 | Jostler et al. | |
| 5,734,326 | A | 3/1998 | Skudera, Jr. | |
| 5,743,070 | A | 4/1998 | Lerner et al. | |
| 5,749,759 | A | 5/1998 | Hopper | |

(Continued)

FOREIGN PATENT DOCUMENTS

| | | |
|---|---|---|
| GB | 641 148 | 11/1998 |

(Continued)

OTHER PUBLICATIONS

European Search Report from EP Application No. 04257926, dated Mar. 15, 2005, p. 3.

(Continued)

*Primary Examiner*—Christopher Harmon
(74) *Attorney, Agent, or Firm*—Calfee, Halter & Griswold LLP

(57) ABSTRACT

A packaging machine utilizing side connected chains of open bags is disclosed. The machine has loading and closure sections which are moveable between operating and cleaning/service positions. A resistance heater subassembly is removeable to enable washdown.

14 Claims, 10 Drawing Sheets

U.S. PATENT DOCUMENTS

| | | | | |
|---|---|---|---|---|
| 5,806,276 | A * | 9/1998 | Lerner et al. | 53/284.7 |
| 5,996,319 | A * | 12/1999 | Lerner et al. | 53/481 |
| 6,055,796 | A * | 5/2000 | Lerner et al. | 53/570 |
| 6,170,238 | B1 | 1/2001 | Lerner | |
| 6,199,351 | B1 * | 3/2001 | Mount | 53/563 |
| 6,550,219 | B2 | 4/2003 | Liao | |
| 6,702,728 | B1 | 3/2004 | Ballos, III | |
| 7,258,656 | B2 | 8/2007 | Lerner et al. | |

FOREIGN PATENT DOCUMENTS

| | | |
|---|---|---|
| WO | WO94/25345 | 11/1994 |

OTHER PUBLICATIONS

Communication pursuant to Article 96(2) EPC from EP Application No. 04257926, dated Mar. 31, 2006, p. 3.

Joker System, A Complete Bag Packaging System Dedicated to Manual and Automatic Filling Operations, Halmstad Sweden (Undated).

* cited by examiner

PACKAGING MACHINE AND PROCESS

RELATED APPLICATIONS

This application is a divisional application of co-pending U.S. application Ser. No. 11/363,337, filed Feb. 27, 2006 which is a divisional of U.S. application Ser. No. 10/738,694, abandoned, filed Dec. 17, 2003, the entire disclosures of which are hereby incorporated by reference for all purposes.

TECHNICAL FIELD

This invention relates to packaging and more particularly to a novel and improved method and apparatus for forming packages using pre-formed side connected bags.

BACKGROUND OF THE INVENTION

U.S. Pat. No. 5,743,070 (the S P patent) entitled PACKAGING MACHINE, MATERIAL, and METHOD discloses a machine for use in packaging which has been highly successful commercially. The S P patent and patents which resulted from divisional applications claim a machine and a plastic web used by that machine as well as a process of making packages.

With the machine of the S P patent the web is fed first through a slitter which splits a top portion into two lips that are respectively grasped between associated pairs of belts for transport through a load section. The belts which transport the web through the load section are more fully described in U.S. Pat. No. 5,722,218 issued Mar. 3, 1998 and entitled Plastic Transport System, herein (the Load Belt patent).

As the web is fed to the load section, the lips are spread to effect the sequential opening of the side connected bags, each into a rectangular opening for receiving a product to be packaged. The lips are then returned to juxtaposed relationship and trimmed as the lips are grasped by further belts in a sealer section. The further belts are preferably belts of the type described and claimed in U.S. Pat. No. 6,170,238 issued Jan. 9, 2001 and entitled Sealing Machine and Method, herein (the Sealer Belt patent).

The SP, Load Belt and Sealer Belt patents are herein incorporated by reference in their entireties.

While the machine of the referenced patents has proved highly successful it is relatively difficult to clean and not suitably constructed for use in packaging food products. Accordingly, it would be desirable to provide a novel and improved machine of the SP Patent constructed to facilitate cleaning and to be adaptable for food packaging.

SUMMARY OF DISCLOSURE

A machine made in accordance with the present disclosure includes loading and closure sections which are pivotal between package forming positions and cleaning positions. In the cleaning position the undersides of the loading and closure sections are positioned for facile cleaning. In the preferred and disclosed arrangement the sections are respectively mounted on an elongated tube for rotation about the tube axis between use and cleaning positions.

The preferred embodiment of the closure section of the machine, includes a heat sealer in which the source of heat for sealing is a resistence electrical heater. In order to enable washdown, such as with a pressure hose, the sealer heat source is readily removable from the balance of the sealer. In the preferred and disclosed arrangement once the heat source is removed from the balance of the closure section, it can be stored in a cabinet mounted on the back of the machine. The cabinet, once an access door is closed, is hermetically sealed so that the heater element when stored in the cabinet is protected from damage by cleaning fluid flowed against the machine.

DETAILED DESCRIPTION

Figure 1:
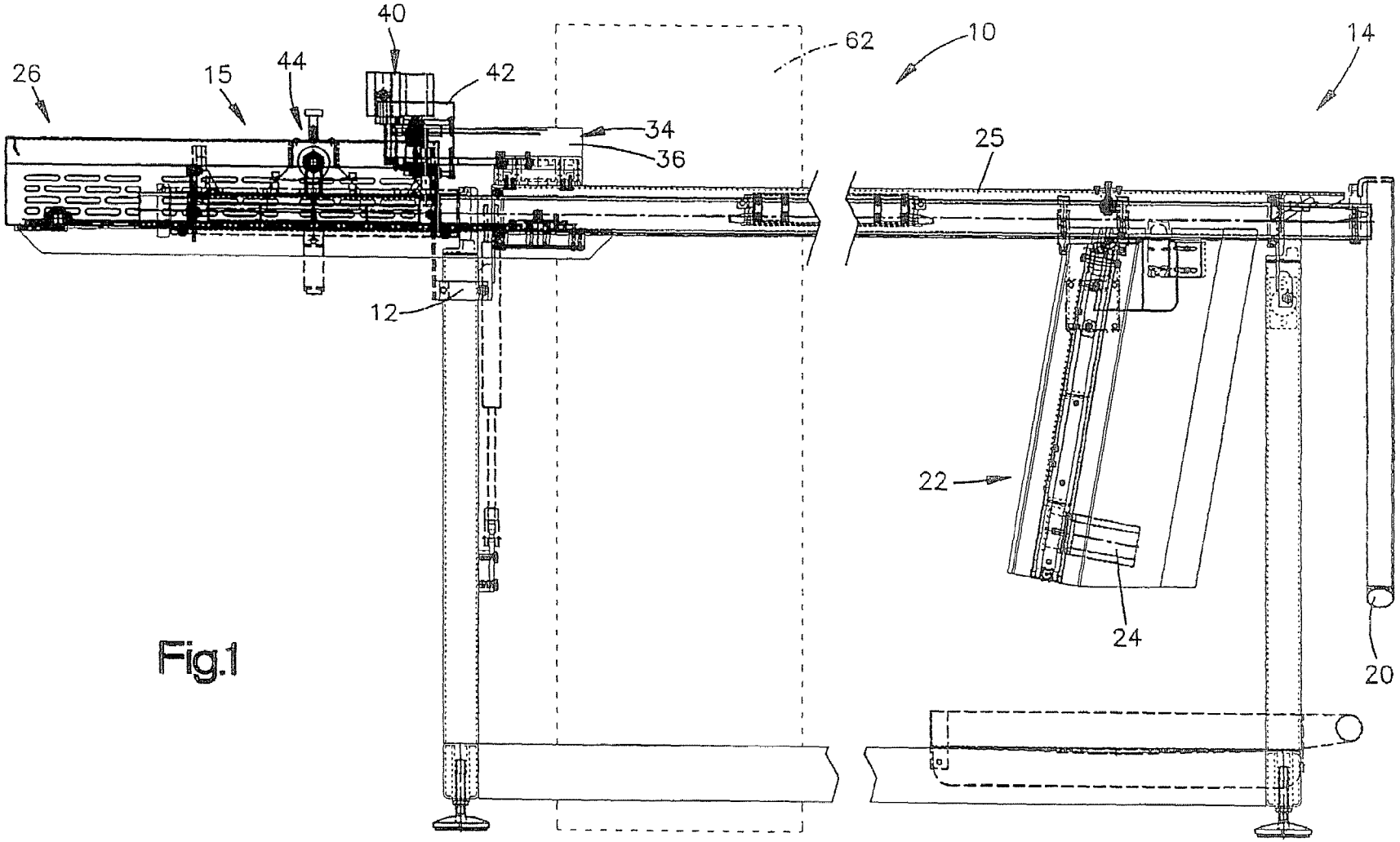
FIG. 1 is a foreshortened side elevational view of the improved packaging machine.
Figure 2:
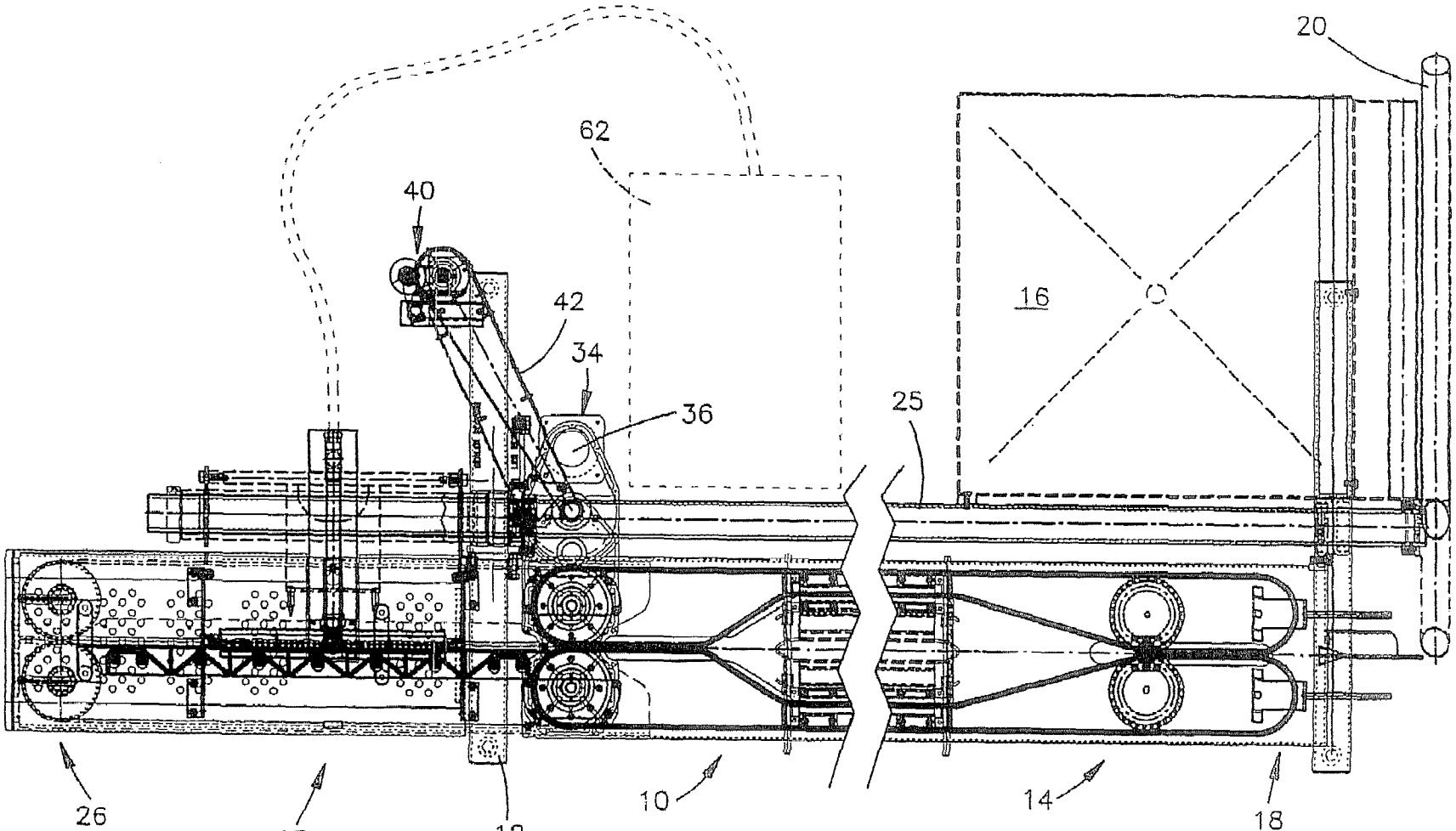
FIG. 2 is a top plan view of the machine foreshortened in an amount corresponding to the four shortening in FIG. 1.

Referring now to the drawings and to FIGS. 1 through 4 in particular, a packaging machine is shown generally at 10. The machine 10 includes a supporting frame 12 upon which load and closure sections 14,15 are mounted. A web supply platform 16 is provided at the back of the machine. The platform 16 is located to the right, as viewed in FIG. 1, under an entrance end 18 of the load section.

When the machine is in use a supply in the form of a web or chain of side connect bags is positioned on the platform. The web is described fully in the SP patent. The web is fed around web guides 20 to the entrance end 18 of the load section 14. The load section is as described in the referenced SP patent with the exception of a redesigned burster 22 which now is driven by a stepper motor 24. Operation of the load section is also as described in the S P patent while transport of the web through the load section is accomplished with belts as described and claimed in the Load Belt patents.

FIGS. 10-14 illustrate the transport belts described in the Load Belt patents. The web is fed through the load section 14 by a pair of grooved main transport belts and a pair of lip transport belts each disposed in the groove of the associated main belt to trap bag lips in the grooves. Adjustable belt spreaders space reaches of the transport belts as they move through a load station whereby to sequentially open the bags into rectangular configurations.

The web 115 is fed from the supply into a bag feed and preparation portion 135 of the bagger section 117. The feed is over the mandrel 124 and past a slitter 136, FIG. 3. The slitter 136 separates the top section 123 into opposed face and back lips 138, 139. The feed through the bag feed and preparation portion 135 is caused by a pair of endless, oppositely rotating, main transport belts 140, 141 supported by oppositely rotating pulley sets 142, 143. The main belts 140, 141 are driven by a stepper motor 144 (FIG. 12) through toothed pulleys 142T, 143T of the sets 142, 143. Other of the pulleys 142S, 143S are spring biased by springs S (FIG. 10) to tension the belts.

Figure 11:
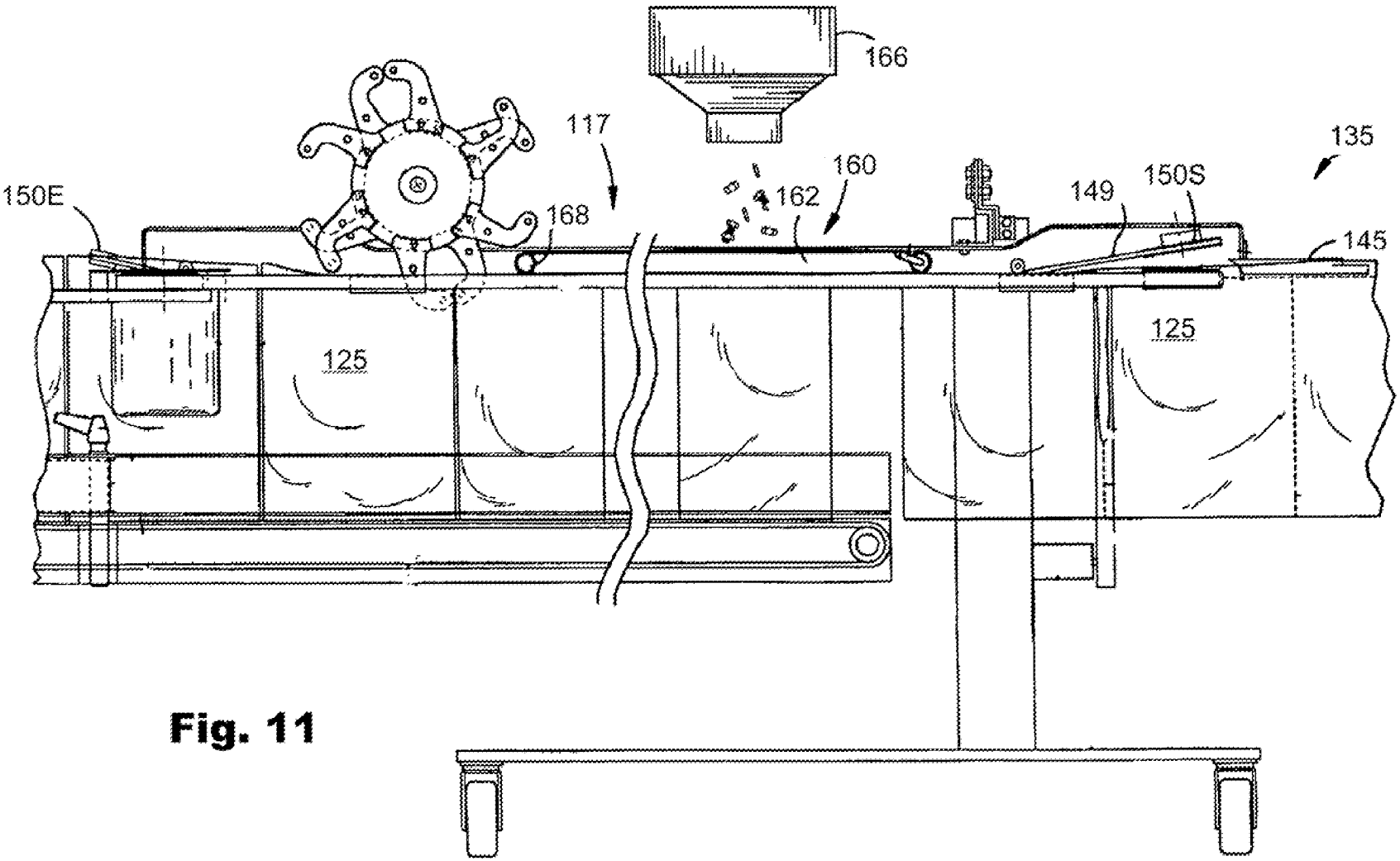
FIG. 11 is an elevational view of the bagger section shown in FIG. 10.
Figures 12, 13, 14:
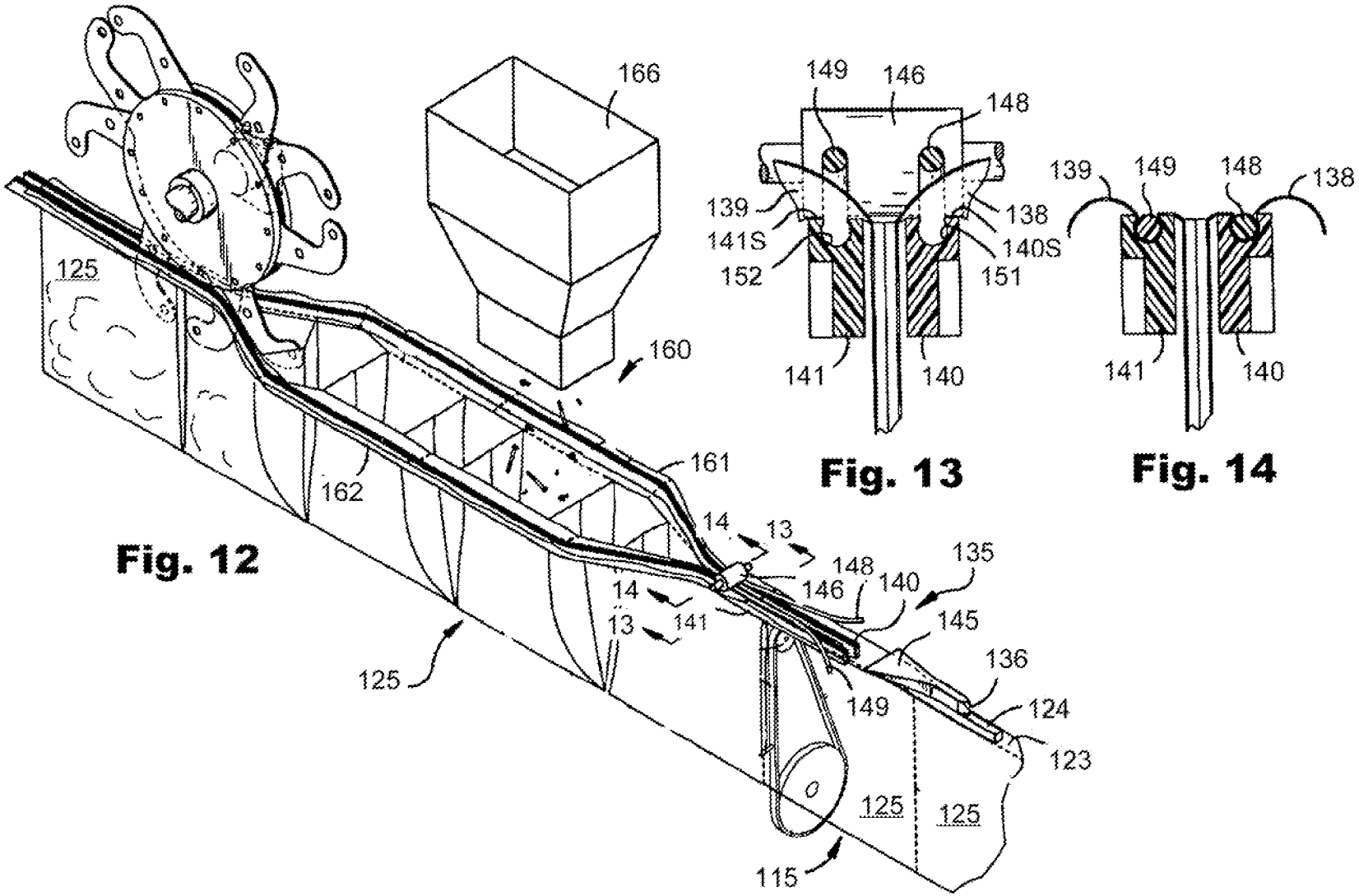
FIG. 12 is a perspective view showing sections of transport belts transporting a web through a load station.
FIGS. 13 and 14 are enlarged sectional views from the planes respectively indicated by lines 13-13 and 14-14 of FIG. 12.

A plow 145 is provided and shown in FIGS. 11 and 12. For clarity of illustration the slitter and the plow have been omitted from FIG. 10. The plow is positioned a short distance upstream from a roller cam 146. As the lips are drawn along by the main transport belts 140, 141, the lips 138, 139 are respectively folded over the top bag engaging surfaces 140S, 141S, of the main transport belts under the action of the plow 145 as depicted in FIG. 14.

Once the lips are folded over the tops of the main transport belts 140, 141, the roller cam 146 presses endless, lip transport and clamp belts 148, 149 into complemental grooves 151, 152 in the main transport belts 141, 142 respectively. Thus, the grooves 151, 152 function as bag clamping surfaces that are complemental with the clamping belts 148, 149. More specifically, the clamp belts are circular in cross section, while the grooves 151, 152 are segments of circles, slightly more than 180° in extent. The camming of the clamp belts into the grooves traps the lips 138, 139 between the clamp belts and the grooves. The lip clamping firmly secures the lips between the coacting belt pairs such that the lips, due to their coaction with the belts, are capable of resisting substantial stuffing forces as products are forced into the bags at a load station 160. Sections of the clamp belts which are not in the grooves 151, 152 are trained around a set of lip transport belt pulleys 150.

The load station 160 includes a pair of parallel belt spreaders 161, 162. The belt spreaders are mirror images of one another. When the transport belts 140,141, are in the position shown in FIG. 12, the bags 125 are stretched between the belts in a rectangular top opening configuration.

A schematic showing of a supply funnel 166 is included in FIG. 12. As suggested by that figure, the products to be packaged are deposited through the rectangular bag openings each time a bag is registered with the supply funnel at the load station.

The main transport pulley sets 142, 143 include two idler pulleys 175, 176 downstream from the load station 160. The idler pulleys 175, 176 are relatively closely spaced to return the main transport belts 140, 141 into substantially juxtaposed relationship following exit from the load station 160.

Since the main and lip transport belts are relatively flexed in a vertical plane as they are brought together to grip a bag and relatively flexed in a horizontal plane as they pass through the load station, it will be seen that the belts are flexible in two directions which are orthoganal to one another.

Once the machine is in operation, the top section 123 of the web 115 is fed along the mandrel 124 and slit by the slitter 136. This forms the lips 138, 139 which are folded over the main transport belts 140, 141 by the action of the plow 145. The lip clamp belts 148, 149 descend from the elevated and spring biased pulleys 150S, as shown in FIG. 12. The roller cam 146 cams the clamp belts 148, 149 respectively into the transport belt recesses 151, 152 to provide very positive and firm support for the bags as they are further processed.

As adjacent runs of the transport belts 140, 141 progress downstream from the bag feed and preparation portion 135, the belts are spread under the action of the belt spreaders 161, 162. As the belts are spread, the lips 138, 139 cause the front and back faces 131, 132 adjacent the lead edge of each bag to separate from the lips 138, 139 by tearing a sufficient length of the perforations between them to allow the lead edge to become the mid point in a bag span between the belts as the bag passes longitudinally through the load station 160. Similarly, the perforations adjacent the trailing edge are torn as the trailing part of the bag is spread until the bag achieves a full rectangular opening as shown in FIG. 12 in particular.

Next a product is inserted into the rectangular bag as indicated schematically in FIGS. 11 and 12. While the schematic showing is of discrete fasteners, it should be recognized that this machine and system are well suited to packaging liquids and bulky products which must be stuffed into a bag, such as pantyhose and rectangular items, such as household sponges.

After the product has been inserted, the adjacent runs of the main transport belts are brought back together and the loaded bag tops are spread longitudinally of the path of travel.

As is best seen in FIG. 11, exit ones 150E of the lip belt pulley set are spaced from the main transport belt and rotatable about angular axes. Expressed more accurately, when the machine is in a vertical loading orientation, the pulleys 150E are above the main transport belt such that the lip transport belts are pulled from the grooves 151, 152.

Figure 3:
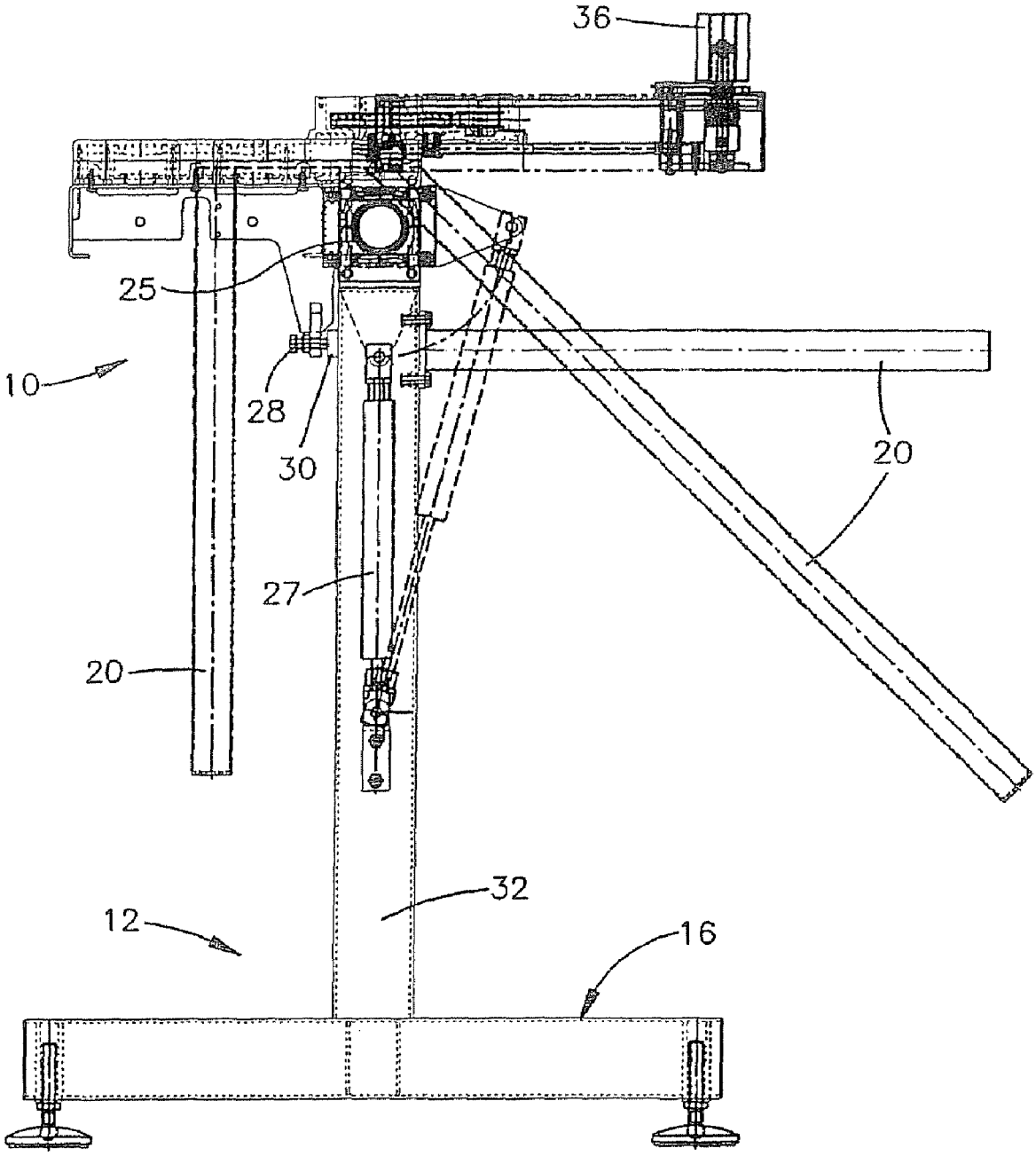
FIG. 3 is an end elevational view of the machine with the load and closure sections in their operating positions.
Figure 4:
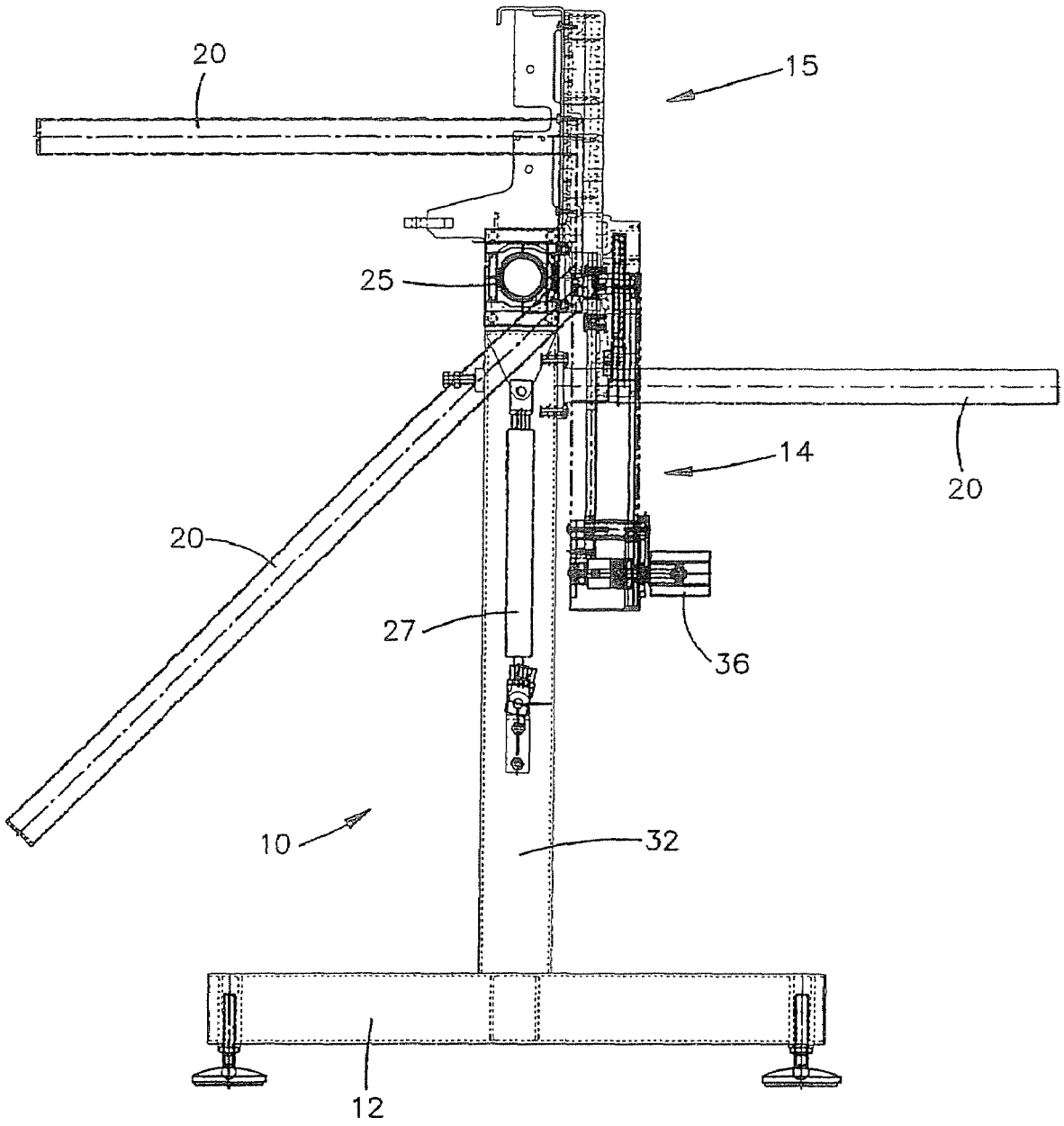
FIG. 4 is an end elevational view of the machine in which the load and closure sections have been moved to their cleaning positions.

One of the outstanding features of the machine 10 is the provision of an elongate cylindrical pivot tube 25 which is the backbone of the machine. The tube 25 is positioned near the top and to the rear of the frame 12. The tube 25 extends the full length of the machine from the entrance end 18 to an exit end 26. The load and closure sections are rotatably mounted on the tube 25. The sections are moveable between generally horizontal operating positions as viewed in FIGS. 1-3 and generally vertical elevated positions as seen in FIG. 4. The elevated positions are provided to facilitate cleaning and service.

A shock absorber 27 cushions movement between the operating and cleaning positions. An adjustable bolt and lock nut 28 act against a stop 30 to accurately position the sections in their operating positions, FIG. 3. When the sections are in their operating positions, the shock absorber is in an extended condition as shown in phantom in FIG. 3. When the sections are in their cleaning position the shock absorber is fully contracted and vertically aligned with frame end post 32, as seen in FIG. 4.

When the sections are in the elevated or upright position of FIG. 4, the center of gravity has gone over center. That is the center of gravity is a) to the left, as seen in FIG. 3, of an imaginary plane extending vertically and bisecting vertical posts 32 of the frame 12 when the sections are in their operating positions and b) to the right, as seen in FIG. 4, of the imaginary plane when in their upright positions. Since the center of gravity has passed over center, the sections will remain in the upright positions until a force is applied to rotate the sections about the axis of the pivot tube to bring the center of gravity to the front (the left as seen in FIG. 3) of the machine and maintain the sections in the operating positions.

Figure 5:
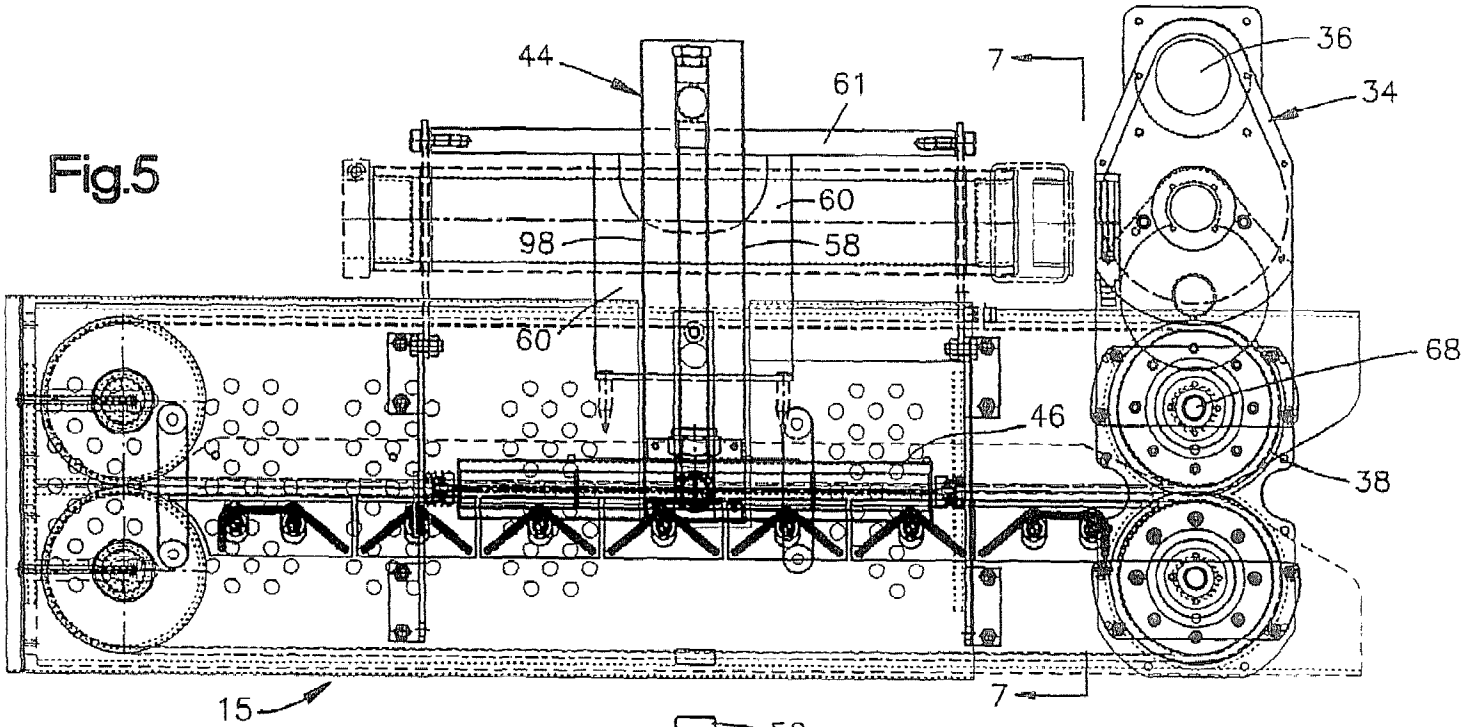
FIG. 5 is a plan view of the closure section on a scale enlarged with respect to FIGS. 1 and 2.
Figure 6:
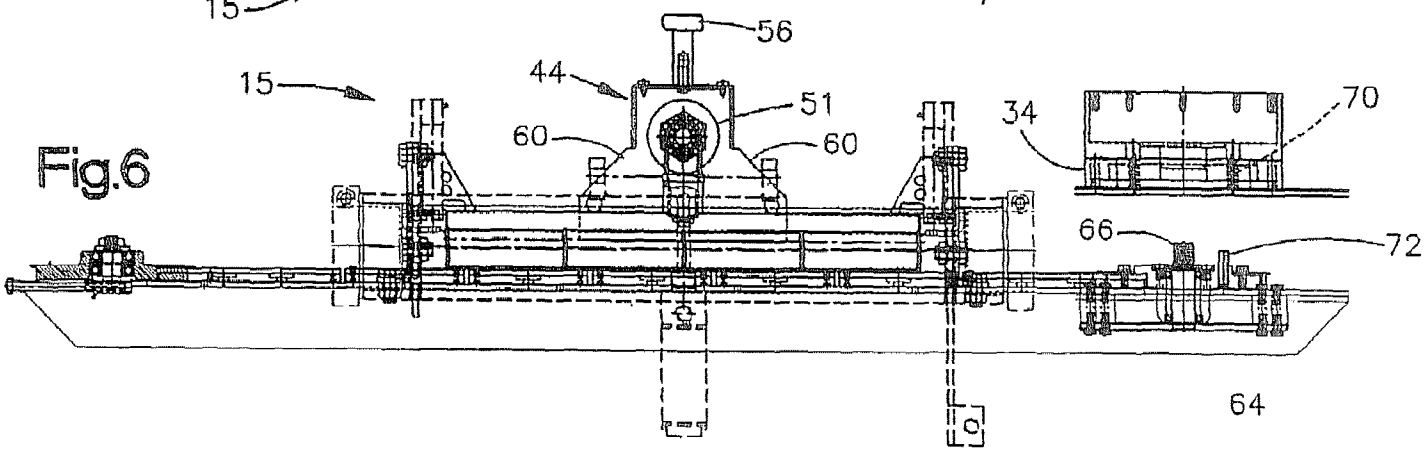
FIG. 6 is a front elevational view of the closure section on the scale of FIG. 5.

A drive 34 is operable to drive the workpiece feed belts of both the loading and the closure sections. Driving force is supplied by a motor 36. The drive also causes an annular knife blade 38 to rotate and sever workpiece web lips which support a plastic web as it is transported through the loading section, FIG. 5. Trimmed scrap is pulled from the machine by a scrap puller 40, FIG. 2. The puller 40 is driven by the motor 36 via a belt 42.

The trimmed web is fed through the closure section by belts made in accordance with the teachings of the Sealer Belt patent and sealing is effected with sealer mechanism as described in the Sealer Belt patent modified to utilize a new and novel heat source subassembly 44. Indeed, the principal novelty of the closer section 15 resides in a heat source subassembly 44 as shown in FIGS. 5 through 9 inclusive.

Referring now to FIGS. 5-9, the subassembly includes an elongate heat tube 46. An elongate resistance heater 48 is positioned eccentrically in the heat tube 46. An air supply conduit 50 is connected to the heat tube to provide a flow of air through a conduit 51 to and over the heater 48 to heat the flowing air. The heated air exits through an elongated opening 52 in the heat tube 46. The heat tube, when in use, is positioned such that the opening 52 is immediately above a small workpiece space between heater belts 54. The heater belts grip work pieces (bag tops) between them and feed the work pieces longitudinally of the opening 52 for sealing.

The provision of a single elongate heating element 48 provides one of the advantages of the present machine over the machine of the S P patent. More specifically the single heating element contrasts with the prior machine which used a series of relatively small resistance heaters. While the series of heaters simplified the machines design in certain respects and reduced repair costs when an element failed, the prior system produced problems. For example a heat sensor was provided to sense heater failure. Early stages of failure of one of the elements remote from the sensor would not be detected and faulty seals would result.

Figure 7:
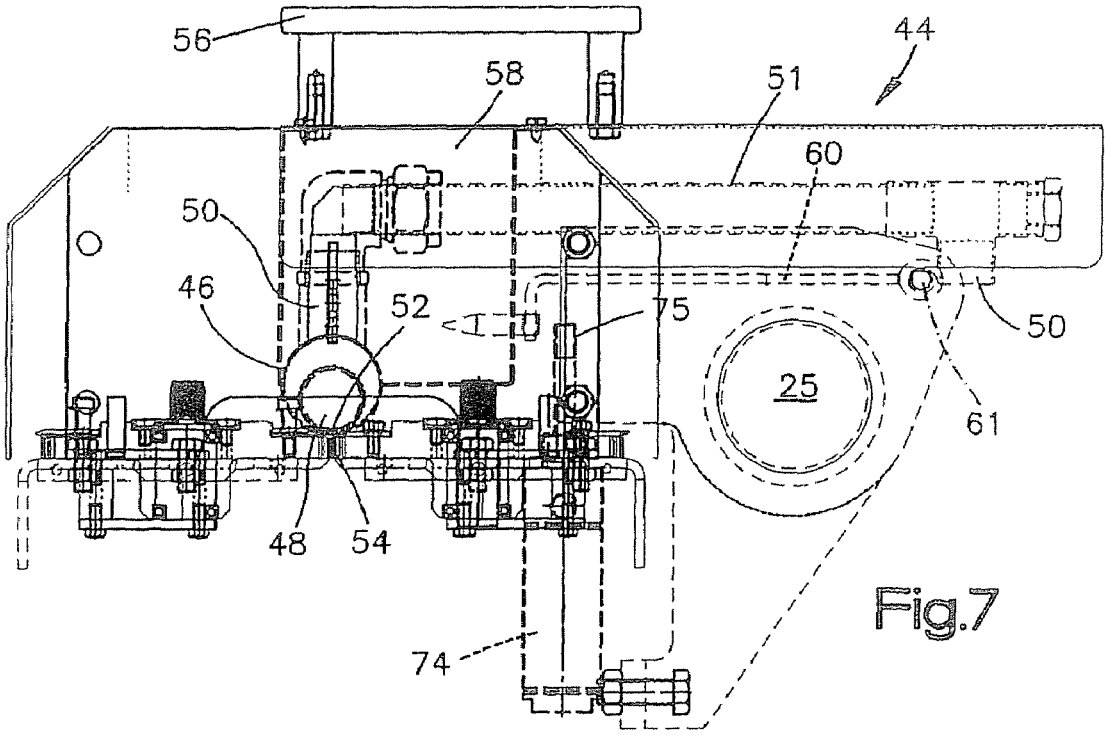
FIG. 7 is a sectional view of the closure section on an enlarged scale with respect to FIGS. 5 and 6 and as seen from a plane indicated by the line 7-7 of FIG. 5.
Figure 8:
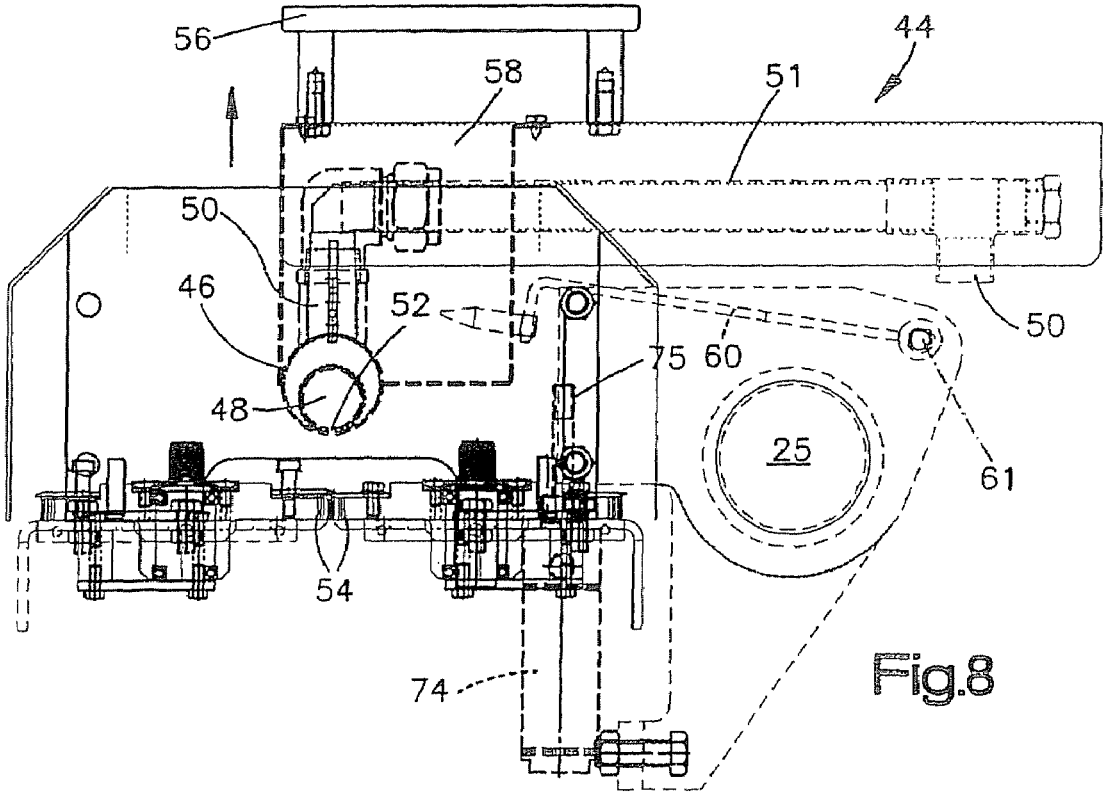
FIG. 8 is a sectional view corresponding to FIG. 7 showing the removable heater element assembly in a partially removed state.
Figure 9:
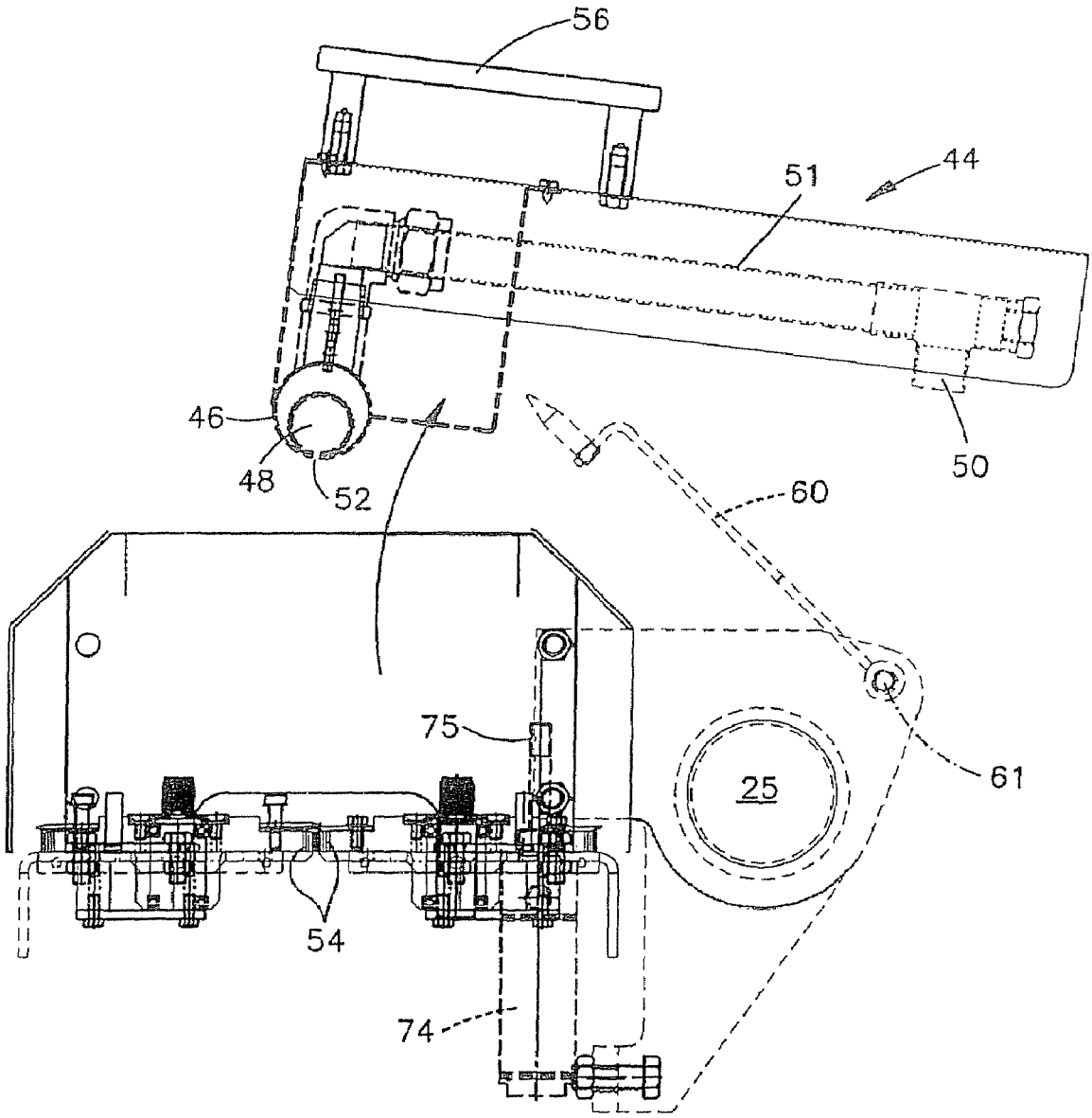
FIG. 9 is a view of the heater sub-assembly as it is removed from the balance of the closure section, all as seen from the same plane as FIGS. 7 and 8 and on the same scale.
Figure 10:
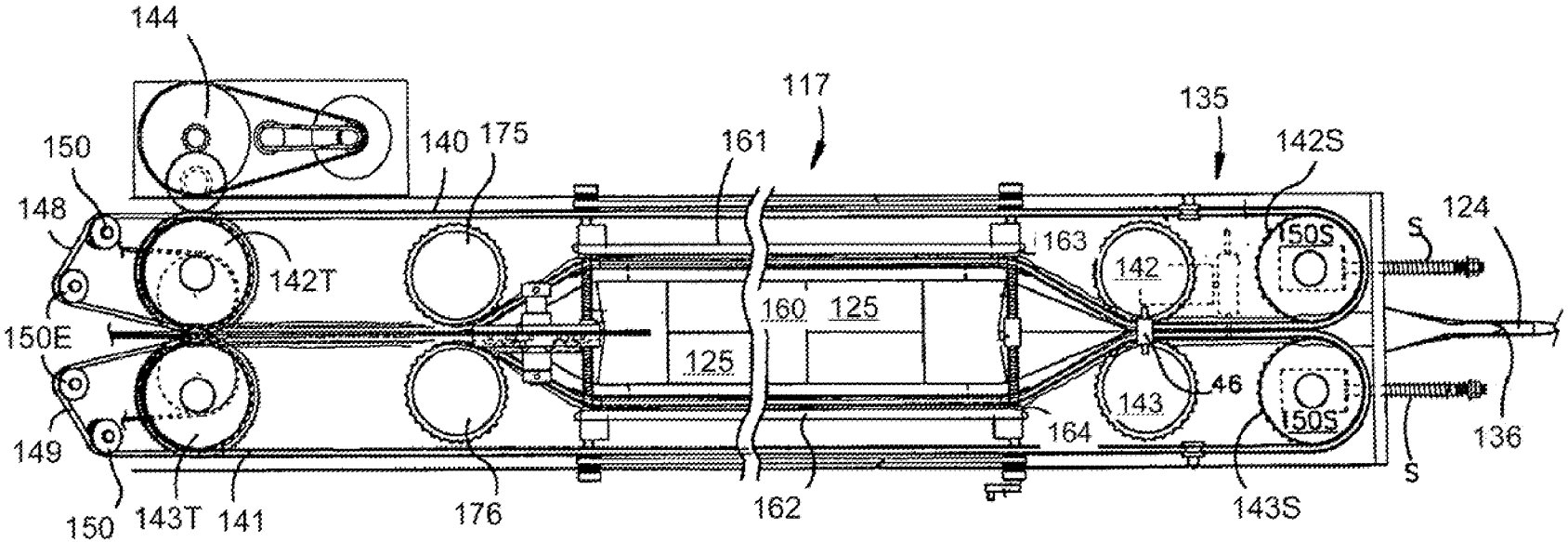
FIG. 10 is a fragmentary top plan view of a bagger section of a machine that includes a film gripping system.

As is best seen in FIGS. 7-9, the subassembly 44 includes a handle 56 to facilitate removal of the subassembly from and return to the closure section. The subassembly 44 includes spaced side mounting plates 58. The mounting plates frictionally engage spaced side locators of the closure section to position the subassembly on the closure section. When the machine is to be cleaned, an operator grasps the handle 56 and moves the subassembly 44 from the mounted position of FIG. 7 through the partially removed position of FIG. 8 to the removed condition of FIG. 9. The subassembly is removed by simply lifting the handle upwardly to remove the subassembly as a locating rod 60 pivots about a pivot rod 61. The subassembly is then placed in a water proof cabinet 62 shown in dotted lines in FIGS. 1 and 2. The cabinet 62 is constructed and positioned such that the loading and closure sections 14, 15 can be moved freely from their operating positions to the cleaning positions and return.

When the subassembly is to be mounted on the closure section, a pointed free end of the locating rod is inserted into a mating hole of the subassembly to achieve location transversely of the path of workpiece travel through the closure section. The locating rod then pivots about the pivot rod 61 to guide the subassembly into its mounted use position on the closure section.

When the sections are to be moved form their operating positions to their cleaning positions, the sections will be cleared of any plastic web used in packaging and the subassembly 44 is removed. It is then necessary to rotate the loading section first. Returning now to FIGS. 1 through 6 and to FIGS. 5 and 6 in particular it will be seen that the reason why the loading section must be rotated first is, the drive 34, apart from a closure part 64, is carried by and forms a part of the loading section 14. As is best understood by reference to FIG. 6, the closure part 64 is disconnected from the remainder of the drive 34 when the loading section is rotated from its operating to its cleaning position. Upon return to the operating positions, the closure section should be returned first.

On subsequent return of the loading section to its operating position a locating pin 66 in the closure part extends into an alignment bore 68 in the drive to bring the drive into appropriate alignment with the closure part. Once the motor 36 is energized the drive will rotate until a drive pin 70 engages a driven pin 72 in the closure part. Once the pins 70,72 are in engagement the sealer belts will be driven to feed loaded bags through the closure section. Any delay between energizing the motor 36 and driving of the sealer belts is not a problem because a web of bags must first be fed through the previously emptied loading section.

Another feature of the invention resides in the provision of a safety air cylinder 74, best seen in FIGS. 7-9. The cylinder is of the type in which a cylinder rod 75 is spring biased outwardly such that in a de-energized condition of the cylinder the rod projects outwardly as far as the cylinder's construction will permit. When the machine is in operation the air under pressure is supplied to the cylinder and the rod is retracted. Upon a malfunction of the machine the cylinder is de-energized and the internal spring drives the piston 75 upwardly. The piston in turn will engage and elevate the subassembly 44 to space the heat source from workpieces between the belts 54.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

We claim:

1. A packaging machine for forming packages from a web of side connected bags comprising:

a frame that supports a pivot tube;

a load section that comprises transport belts, the transport belts being routed to open bags of the web for loading;

the load section being pivotally connected to the pivot tube, such that the transport belts are pivotable with respect to the frame between a horizontal operating position and a vertical cleaning position;

wherein a center of gravity of said load section is on a first side of a center of said pivot tube when said load section is in said horizontal operating position such that gravity maintains said load section in said horizontal operating position; and wherein the center of gravity of said load section is on a second side of a center of said pivot tube when said load section is in said vertical cleaning position such that gravity maintains said load section in said vertical cleaning position.

2. The machine of claim 1 wherein the pivot tube extends from an entrance end of the frame to an exit end of the frame.

3. The machine of claim 1 further comprising a closure section mounted to the elongated pivot tube, the closure section includes heater belts that feed the web through the closure section and a heat source assembly that seals the web that passes through the closure section.

4. The machine of claim 1 wherein the closure section is pivotably coupled to the elongated pivot tube to allow the heater belts to be rotated with respect to the frame between a closure section horizontal operating position and a closure section vertical cleaning position;

wherein a center of gravity of said closure section is on a first side of a center of said pivot tube when said closure section is in said closure section horizontal operating position such that gravity maintains said closure section in said closure section horizontal operating position; and wherein the center of gravity of said closure section is on a second side of a center of said pivot tube when said closure section is in said closure section vertical cleaning position such that gravity maintains said closure section in said closure section vertical cleaning position.

5. The machine of claim 1 wherein the load section comprises first and second pairs of transport belts that grip first and second lips of the web and wherein the first and second pairs of transport belts are routed to open bags of the web for loading.

6. The machine of claim 1 wherein the transport belts are routed to close the bags after the bags have been loaded.

7. The machine of claim 6 comprising:

a closure section mounted to the pivot tube, the closure section includes heater belts that feed the web through the closure section and a heat source assembly that seals the web that passes through the closure section;

wherein the heater belts and transport belts are driven by a common drive and wherein the transport belts of the load section are pivotable with respect to the frame independent of the heater belts of the closure section.

8. The machine of claim 7 wherein the heat source assembly is removable for cleaning of the remainder of the closure section.

9. The machine of claim 8 wherein cleaning can be effected by wash down after said heating source assembly is removed.

10. The machine of claim 8 further including a waterproof cabinet having space for storage of the heating source assembly during a machine wash down.

11. The machine of claim 7 wherein a heat source of the heat source assembly includes only a single elongate heater element.

12. The machine of claim 11 wherein the element is eccentrically mounted in a heat tube having an air inlet and an outlet.

13. The machine of claim 7 wherein the common drive is disconnected from the heater belts when the transport belts are rotated with respect to the heater belts.

14. The machine of claim 7 wherein a drive mechanism is secured to one of the load and the closure sections and drivingly connected to one of the transport belts and the heater belts and operably connected to the other of the transport belts and the heater belts when the load and closure sections are in operating positions.

* * * * *